US006617952B1

(12) United States Patent
Yu

(10) Patent No.: US 6,617,952 B1
(45) Date of Patent: Sep. 9, 2003

(54) SWITCH WITH ADJUSTABLE SPRING

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 0 days.

(21) Appl. No.: 10/082,948

(22) Filed: Feb. 26, 2002

(51) Int. Cl.[7] ..... H01H 61/02; H01H 71/16

(52) U.S. Cl. ..... 337/94; 337/59; 337/66; 337/72

(58) Field of Search ..... 337/59, 36–39, 337/52, 58, 62, 66, 70, 72, 85, 91, 94; 200/339, 341, 251, 261, 286, 322

(56) References Cited

U.S. PATENT DOCUMENTS 3,686,602 A * 8/1972 Jullien-Davin ..... 337/66
3,768,057 A * 10/1973 Sekira et al. ..... 337/349
4,990,882 A * 2/1991 Peter ..... 337/66
5,223,813 A * 6/1993 Cambreleng et al. ..... 337/66
5,262,748 A * 11/1993 Tsung-Mou ..... 337/66
5,498,846 A * 3/1996 Chin ..... 200/557
5,889,457 A * 3/1999 Hsu et al. ..... 337/59
6,072,381 A * 6/2000 Yu ..... 337/37
6,275,134 B1 * 8/2001 Chen ..... 337/37
6,353,526 B1 * 3/2002 Pellon ..... 361/115
6,445,273 B1 * 9/2002 Yu ..... 337/37

FOREIGN PATENT DOCUMENTS

CH 647094 A * 12/1984 ..... H01H/71/16

* cited by examiner

*Primary Examiner*—Anatoly Vortman

(57) ABSTRACT

A switch includes an N-shaped spring which is connected between an inside of the base of the switch and an end of a bimetal plate. The bimetal plate has a contact point and is pushed to let the contact point contact an another contact point on one of three terminal plates. An adjusting member is movably engaged with the base and contacts an end of the N-shaped spring so as to adjust the position of the N-shaped member.

5 Claims, 7 Drawing Sheets

SWITCH WITH ADJUSTABLE SPRING

FIELD OF THE INVENTION

The present invention relates to a switch that includes an N-shaped spring connected to an end of a bimetal plate. An adjusting screw is engaged with one end of the N-shaped spring so as to adjust the position of the end of the spring.

BACKGROUND OF THE INVENTION

A conventional switch is shown in FIGS. 1 and 2 and includes a base 6 having an open top to receive a button 7 therein. Three terminal plates 61, 62 and 63 extend through three slots defined through the bottom of the base 6. The terminal plate 62 has a first contact point 922 and a bimetal plate 92 is located above the terminal plate 62. A second contact point 921 is connected to a bottom of the bimetal plate 92. An N-shaped spring 91 has one end pivotally connected to a recess 920 in one end of the bimetal plate 92, and the other end of the spring 91 is pivotally received in a groove 60 in an inside of the base 6. A swing member 83 pivotally connected between two opposite insides of the base 6 and a cone-shaped protrusion extends from an inside of the groove of the swing member 83 so as to define two recesses 831 separated by the protrusion. A connection plate 93 is pivotally connected to an end of the swing member 83 and the bimetal plate 92. A pushing rod 81 has a top end connected to an underside of the button 7 and a lower end of the pushing rod 81 can be inserted in either of the two recesses 831 in the swing member 83. A spring 82 is mounted to the pushing rod 81 to allow the button 7 to return.

As shown in FIG. 3, when pushing the button 7, the pushing rod 81 pushes the swing member 83 counter clockwise so that the two contact points 921, 922 contact and the circuit is closed. The bimetal plate 92 is maintained its position after the N-shaped spring 91 is deformed below its critical deformation ling "L", and the button 7 is biased upward by the spring 82. As shown in FIGS. 4 and 5, when pushing the button 7 again, the pushing rod 81 is pivoted the swing member 83 clockwise, and the two contact points 921, 922 are separated again to open the circuit.

When the current overrides, the bimetal plate 92 is supposed to be deformed and overcomes the force of the N-shaped spring 91 to separate the two contact points 921, 922. However, the spring force of the N-shaped spring 91 could be too large to be overcome by the deformation of the bimetal plate 92. The deformation efficiency of the bimetal plate 92 could not be large enough to provide enough deformation to the bimetal plate 92 such that the N-shaped spring 91 does not change its position and the circuit cannot be opened in time.

SUMMARY OF THE INVENTION

In accordance with one aspect of the present invention, there is provided a switch comprising a base having a button on a top thereof and three terminal plates respectively extend through the bottom of the base. A groove is defined in an inside of the base and an adjusting hole is defined in the base and communicates with the groove. A first contact point is connected to one of the terminal plates.

A bimetal plate is located in the base an N-shaped spring has one end thereof engaged with the groove in the inside of the base, and the other end of the N-shaped spring is pivotally connected to the bimetal plate.

A swing member is pivotally connected between two opposite insides of the base and a cone-shaped protrusion extends from a top of the swing member so as to define two notches separated by the protrusion. A connection plate is connected between an end of the swing member and the bimetal plate.

A pushing rod has a spring mounted thereto and is located between the button and the swing member. A lower end of the pushing rod is located in one of the two notches in the swing member.

An adjusting member is movably engaged with the adjusting hole and an end of the adjusting member contacts the N-shaped spring in the groove.

The primary object of the present invention is to provide a switch having an adjusting member which is movably engaged with the base of the switch so as to adjust the position of an N-shaped spring to ensure the deformation of the bimetal plate is able to overcome the spring force of the N-shaped spring when the current overrides.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
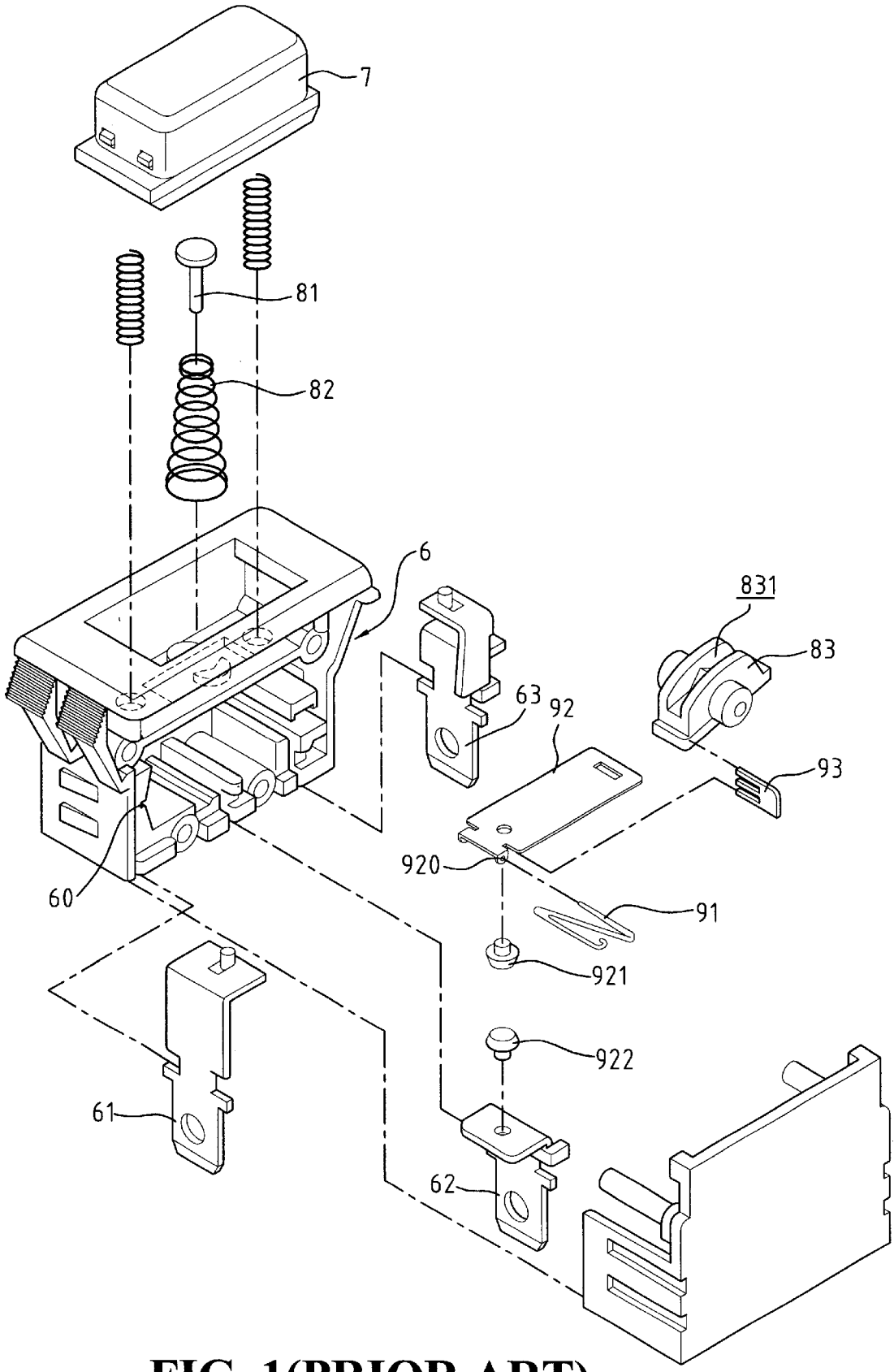
FIG. 1(PRIOR ART)
FIG. 1 is an exploded view to show a conventional switch.
Figure 2:
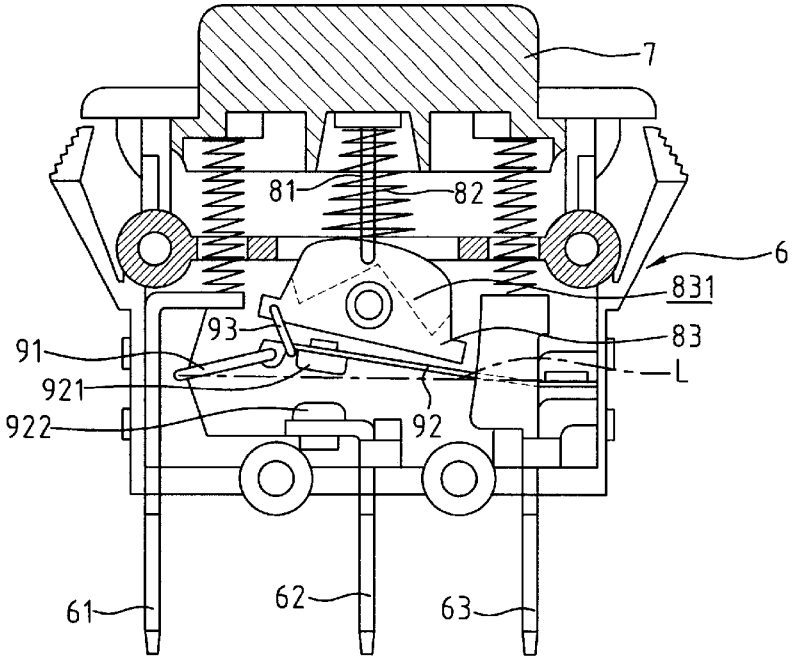
FIG. 2(PRIOR ART)
FIG. 2 is a cross sectional view to show the conventional switch is in open circuit status.
Figure 3:
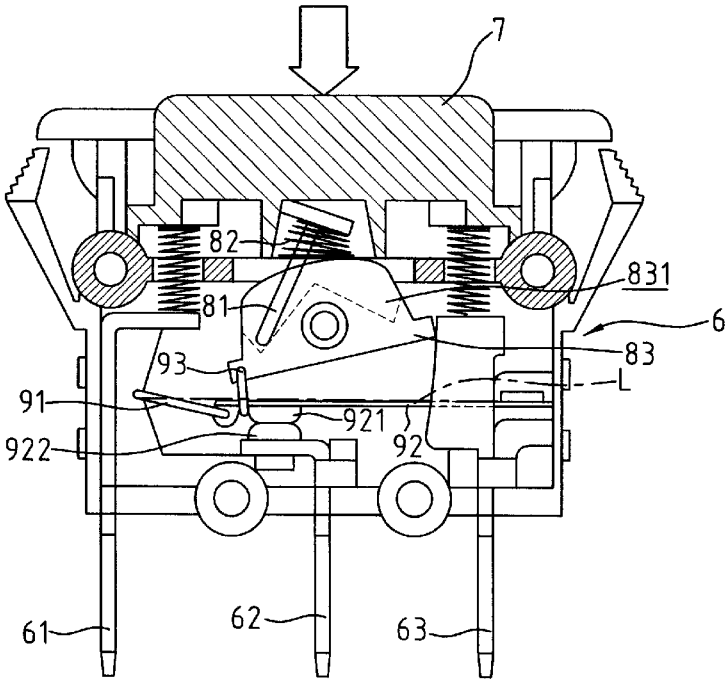
FIG.3(PRIOR ART)
FIG. 3 is a cross sectional view to show the button of the conventional switch is pushed to close the circuit.
Figure 4:
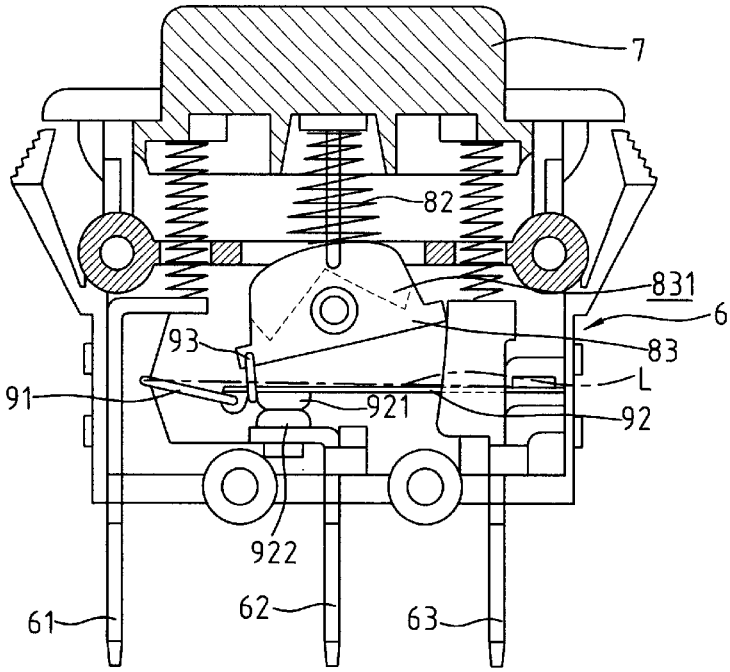
FIG. 4(PRIOR ART)
FIG. 4 is a cross sectional view to show the button of the conventional switch returns to its original position when the circuit is closed.
Figure 5:
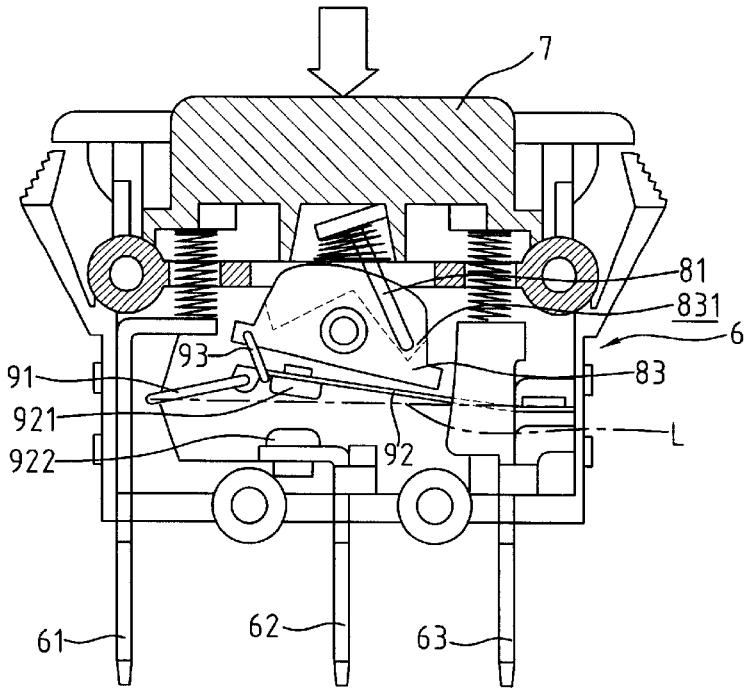
FIG. 5(PRIOR ART)
FIG. 5 is a cross sectional view to show the button of the conventional switch is pushed again to open the circuit.
Figure 6:
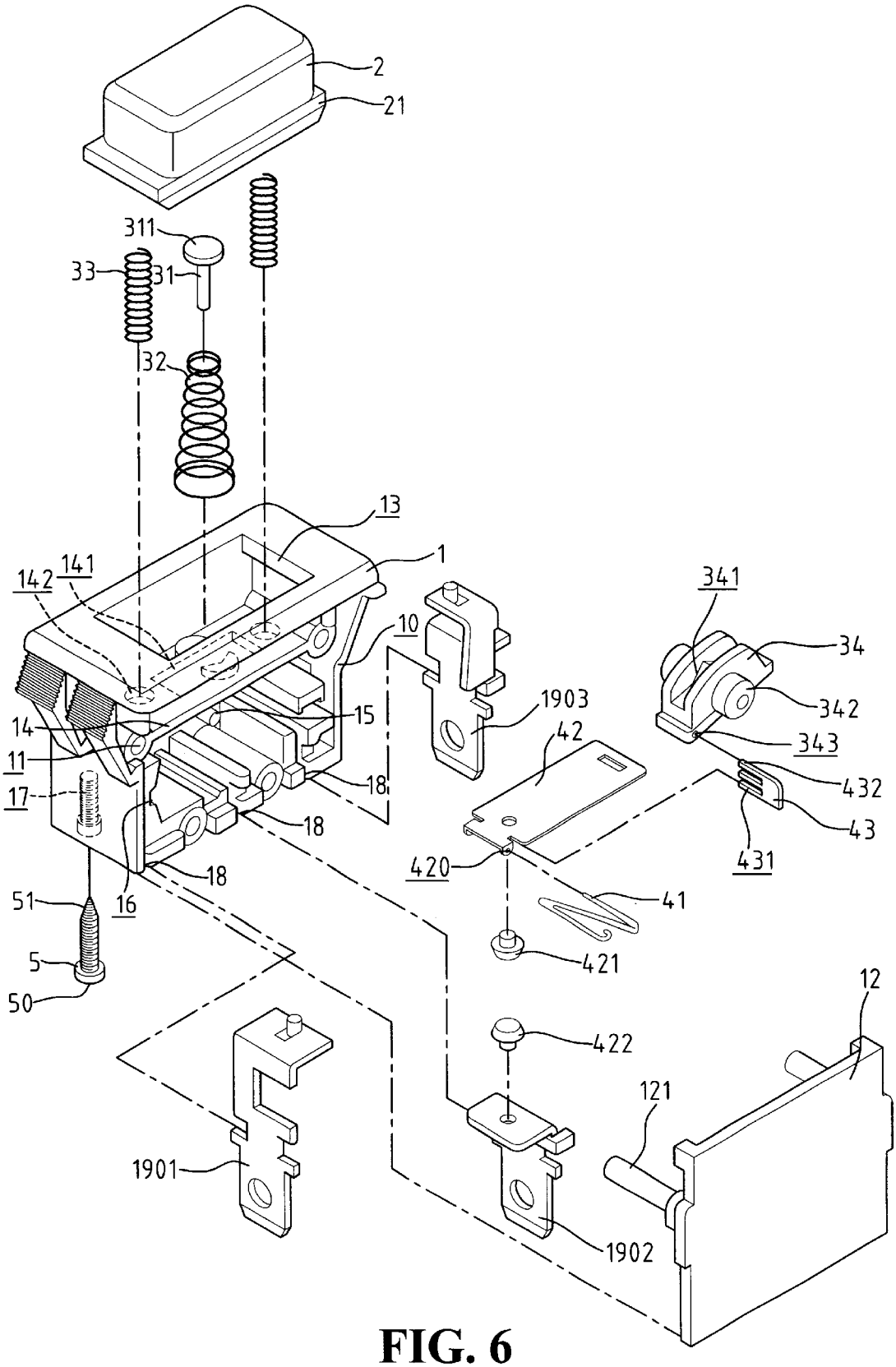
FIG. 6 is an exploded view to show the switch of the present invention.
Figure 7:
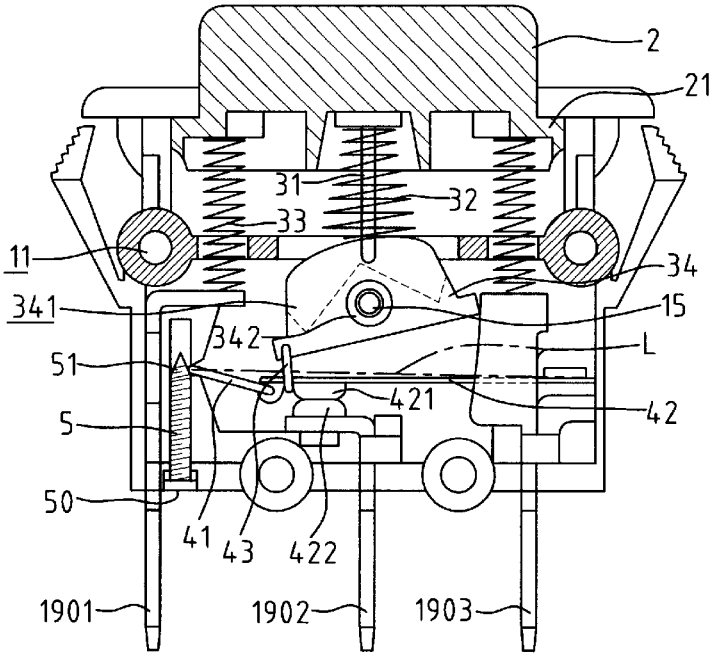
FIG. 7 is a cross sectional view to show the switch in open circuit status.

Referring to FIGS. 6 and 7, the switch of the present invention comprises a base 1 having an open top 13 for a button 2 being engaged therewith. The button 2 has a peripheral flange 21 which is engaged with a periphery defining the open top 13 of the base 1 so that the button 2 will not drop from the open top 13. Three slots 18 are defined through a bottom of the base 1 and three terminal plates 1901. 1902, 1903 are respectively inserted in the slots 18. The base 1 has an open side 10 which can be sealed by a cover 12 by inserting rods 121 extending from the cover 12 in holes 11 defined in the walls of the base 1. A groove 16 is defined in an inside of the base 1 and an adjusting hole 17 is defined in the bottom of the base 1. The adjusting hole 17 communicates with the groove 16. A first contact point 422 is connected to the terminal plate 1902. A flange 14 is located in the base 1 and includes holes 141, 142 so that two springs 33 extend through the two holes 142 and a pushing rod 31 and a spring 32 mounted to the pushing rod 31 extend through the hole 141. The pushing rod 31 has an enlarged head 311 at a top end of the pushing rod 31 and the enlarged head 311 contacts an underside of the button 2.

A bimetal plate 42 is located in the base 1 and a recess 420 is defined in a first end of the bimetal plate 42. An N-shaped spring 41 has one end thereof engaged with the groove 16 in the inside of the base 1, and the other end of the N-shaped spring 41 is received in the recess 420 in the bimetal plate 42.

A swing member 34 is pivotally connected between two opposite insides of the base 1 by inserting two rods 15 extending from the two opposite insides of the base 1 in holes defined in a shaft 342 of the swing member 34. A recess is defined in a top of the swing member 34 and a cone-shaped protrusion extends from a top of the swing member 34 and is located in the recess so as to define two notches 341 separated by the protrusion. A lower end of the pushing rod 31 is located in one of the two notches 341 in the swing member 34. A connection plate 43 has a slot 431 clamping the first end of the bimetal plate 42 and a rib 432 inserted in a hole 343 defined in an end of the swing member 34.

Figure 8:
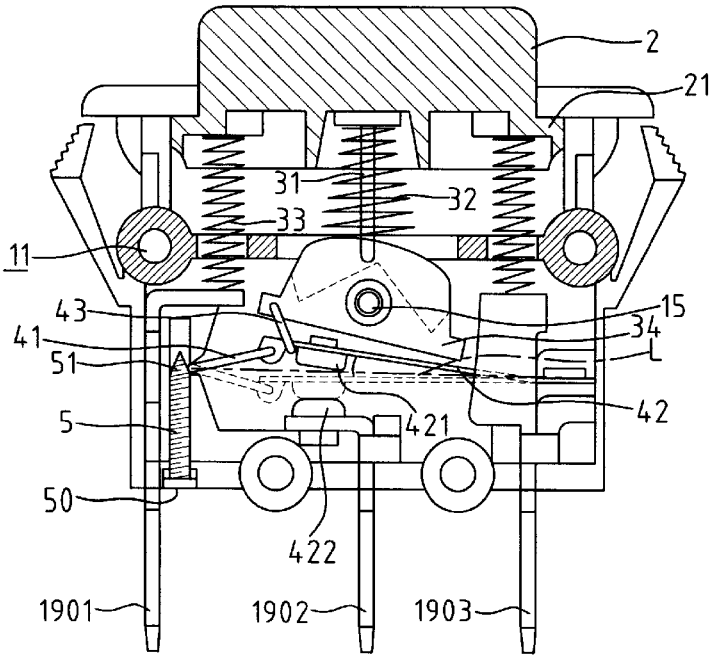
FIG. 8 shows that the bimetal plate is deformed when the current overrides and the two contact points are separated.

As shown in FIG. 8, when the current overrides, the bimetal plate 42 is deformed and the first end of the bimetal plate 42 is curved upward to pivot the N-shaped spring 41. After the N-shaped spring 41 is pivoted over the deformation critical line "L" of the N-shaped spring 41, the deformation of the bimetal plate 42 overcomes the spring force of the N-shaped spring 41 so as to separate the two contact points 421, 422 to open the circuit.

An adjusting member 5 which is a crew having outer threads which are threadedly engaged with inner threads defined in the adjusting hole 17 so that the adjusting member 5 can be movably engaged with the adjusting hole 17 by using a screw driver to engage and rotate the working end 50 of the adjusting member 5. The working end 50 can be Phillips head, slotted head or flat head so that a screw driver can rotate the adjusting member conveniently. The adjusting member 5 has an cone-shaped tip 51 and the end of the N-shaped spring 41 in the groove 16 contacts the periphery of the cone-shaped tip 51 such that the condition of the N-shaped member 41 can be adjusted by moving the adjusting member 5. In other words, the movement of the end of the N-shaped spring 41 in the groove 16 adjusts the position of the N-shaped spring 41 so as to ensure that the N-shaped spring 41 is positioned correctly and the deformation of the bimetal plate 42 can overcome the force of the N-shaped spring 41 when the current overrides.

Figure 9:
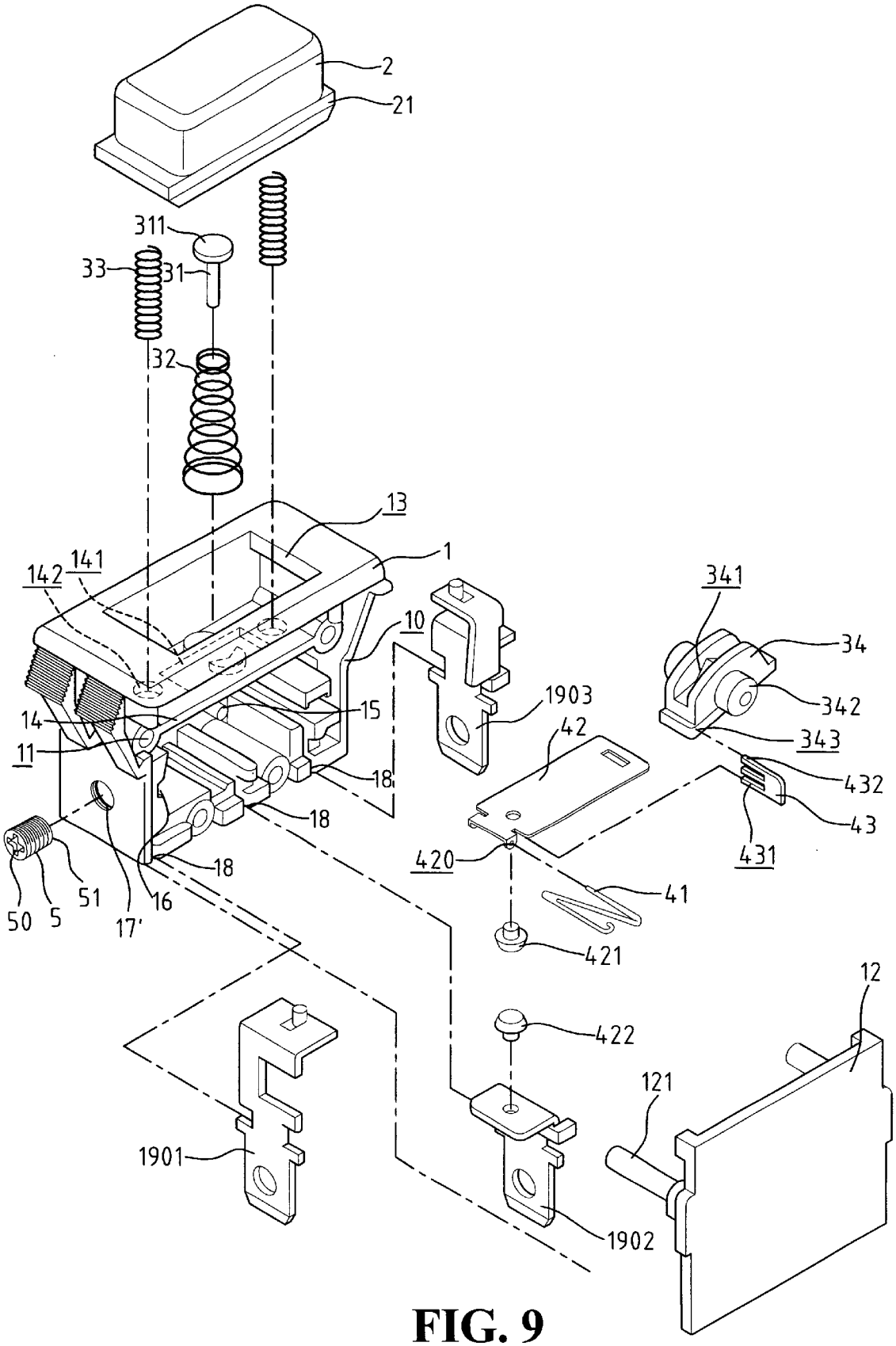
FIG. 9 is an exploded view to show another embodiment of the switch of the present invention.
Figure 10:
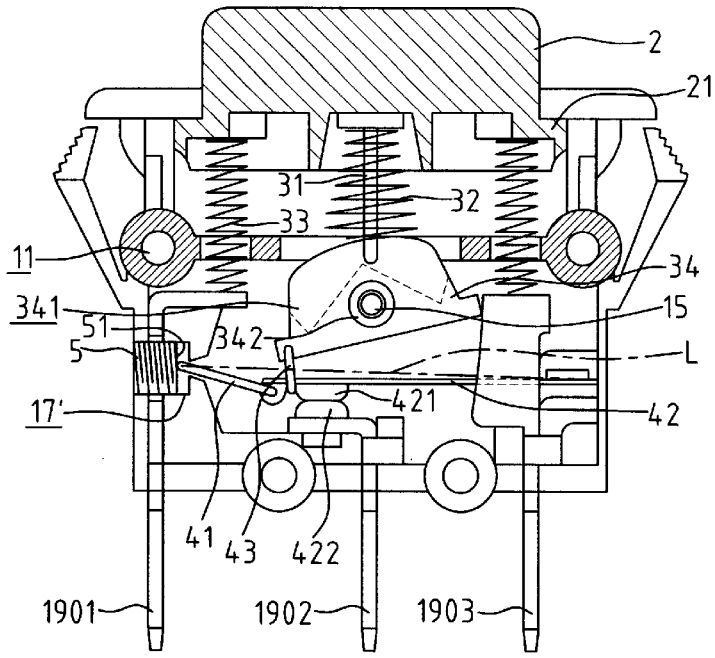
FIG. 10 is a cross sectional view to show the switch of the embodiment as illustrated in FIG. 9 is in close circuit status.
Figure 11:
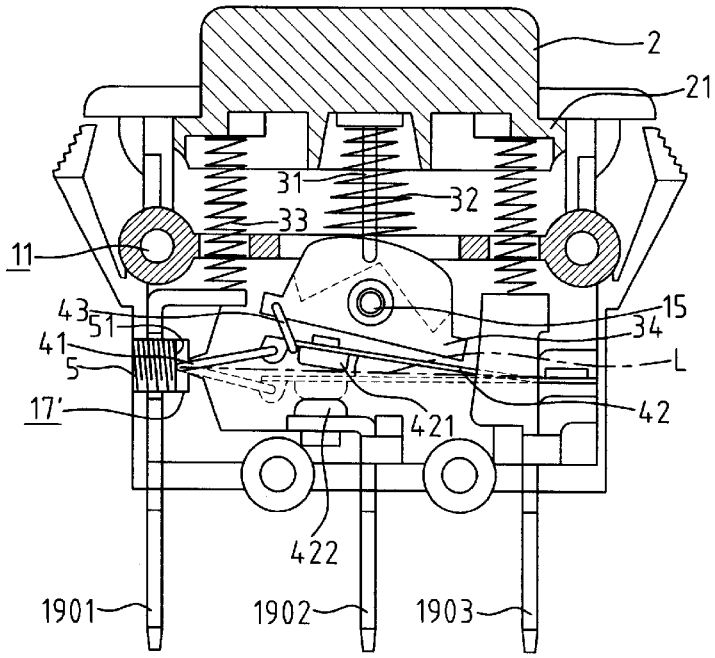
FIG. 11 shows that the bimetal plate of the switch of the embodiment as illustrated in FIG. 9 is deformed when the current overrides and the two contact points are separated.

FIGS. 9 to 11 show another embodiment wherein the adjusting hole 17' is defined in an end of the base 1 and the adjusting member 5 has a flat end 51 which contacts the end the N-shaped spring 41 received in the groove 16.

While we have shown and described the embodiment in accordance with the present invention, it should be clear to those skilled in the art that further embodiments may be made without departing from the scope of the present invention.

What is claimed is:

1. A switch comprising:

a base having an open top for a button being engaged therewith, three slots defined through a bottom of the base and three terminal plates respectively inserted in the slots, a groove defined in an inside of the base and an adjusting hole defined in the base and communicating with the groove, a first contact point connected to one of the terminal plates;

a bimetal plate located in the base and a recess defined in a first end of the bimetal plate, an N-shaped spring having one end thereof engaged with the groove in the inside of the base, the other end of the N-shaped spring received in the recess in the bimetal plate;

a swing member pivotally connected between two opposite insides of the base and a recess defined in a top of the swing member, a cone-shaped protrusion extending from a top of the swing member and located in the recess so as to define two notches separated by the protrusion, a connection plate connected between an end of the swing member and the first end of the bimetal plate;

a pushing rod having an enlarged head at a top end of the pushing rod and a spring mounted to the pushing rod, the enlarged head contacting an underside of the button and a lower end of the pushing rod located in one of the two notches in the swing member, and an adjusting member movably engaged with the adjusting hole and an end of the adjusting member contacting the N-shaped spring in the groove.

2. The switch as claimed in claim 1, wherein the adjusting hole is defined in the bottom of the base and the adjusting member has an cone-shaped tip, the end of the N-shaped spring contacting the periphery of the cone-shaped tip.

3. The switch as claimed in claim 2, wherein the adjusting hole has inner threads and the adjusting member has outer threads which are threadedly engaged with the inner threads.

4. The switch as claimed in claim 1, wherein the adjusting hole is defined in an end of the base and the adjusting member has a flat end, the end of the N-shaped spring contacting the flat end of the adjusting member.

5. The switch as claimed in claim 4, wherein the adjusting hole has inner threads and the adjusting member has outer threads which are threadedly engaged with the inner threads.

* * * * *